US005584279A

United States Patent [19]

Brunnhofer

[11] Patent Number: 5,584,279

[45] Date of Patent: Dec. 17, 1996

[54] THERMALLY INSULATED FUEL SYSTEM FOR MOTOR-VEHICLE ENGINE

[75] Inventor: Erwin Brunnhofer, Fuldabrück, Germany

[73] Assignee: Technoflow Tube-Systems GmbH, Fuldabruck, Germany

[21] Appl. No.: 357,499

[22] Filed: Dec. 16, 1994

[30] Foreign Application Priority Data

Dec. 28, 1993 [DE] Germany ..... 43 44 777.5

[51] Int. Cl.[6] ..... F02M 15/00

[52] U.S. Cl. ..... 123/541; 123/514

[58] Field of Search ..... 123/514, 179.17, 123/497, 541, 468, 516, 456

[56] References Cited

U.S. PATENT DOCUMENTS

| | | | |
|---|---|---|---|
| 2,994,311 | 8/1961 | Shuck | 123/541 |
| 3,477,238 | 11/1969 | Race | 123/541 |
| 3,974,809 | 8/1976 | Stumpp | 123/452 |
| 4,248,194 | 2/1981 | Drutchas | 123/497 |
| 4,260,333 | 4/1981 | Schillinger | 123/497 |
| 4,370,967 | 2/1983 | Gmelin | 123/516 |
| 4,782,808 | 11/1988 | Bostick | 123/516 |
| 4,926,829 | 5/1990 | Tuckey | 123/497 |

FOREIGN PATENT DOCUMENTS

| | | | |
|---|---|---|---|
| 3214874 | 11/1983 | Germany | 123/541 |

*Primary Examiner*—Carl S. Miller
*Attorney, Agent, or Firm*—Herbert Dubno; Andrew Wilford

[57] ABSTRACT

A motor-vehicle engine system has an internal-combustion four-cycle engine having a fuel-supply manifold, a substantially closed but vented fuel tank holding a supply of gasoline, a fuel pump having an input connected to the tank and an output, and a fuel-feed line connected between the fuel-pump output and the fuel-supply manifold. A controller connected to the engine and to the pump operates the fuel pump at a throughput rate directly related to an engine speed. Insulation at least surrounds and thermally insulates the fuel tank, fuel-feed line, and fuel-supply manifold from their surroundings. A return line connected to the fuel tank is provided with an overpressure valve that is controlled to open briefly only on startup of the engine.

6 Claims, 1 Drawing Sheet

PUMP
ENGINE
1
2
3
4
5
6
7
8
9
10
11
12

1
2
3
4
6
8
10

THERMALLY INSULATED FUEL SYSTEM FOR MOTOR-VEHICLE ENGINE

FIELD OF THE INVENTION

The present invention relates to a motor-vehicle fuel system. More particularly this invention concerns a fuel-injection system for a four-cycle internal-combustion engine of a motor vehicle.

BACKGROUND OF THE INVENTION

A standard fuel-injected engine system has a four-cycle internal-combustion engine with a fuel-supply manifold connected via injectors to the individual combustion chambers, a fuel tank holding a supply of gasoline, a fuel-supply line leading from the tank to the fuel-supply manifold, and a pump in the line. The tank is normally closed but vented for pressure-equalization purposes into the air-intake manifold of the engine. A return line runs from the fuel-supply manifold back to the tank and an overpressure valve in this return line prevents excess pressure from building up in the fuel manifold. The tank is normally at atmospheric pressure, although it may be somewhat pressurized.

The disadvantage of this system is that the gasoline is moved about and heated considerably. The tank itself is normally juxtaposed with components of the exhaust system, and both the fuel-supply and return lines run along the muffler and other exhaust-system parts so that the fuel in them is heated. In addition the pump itself generates heat and is itself often mounted on or in the fuel tank so that it also heats the fuel. This heat can break down the fuel by vaporizing off the more highly volatile components of the gasoline.

OBJECTS OF THE INVENTION

It is therefore an object of the present invention to provide an improved motor-vehicle engine system.

Another object is the provision of such an improved motor-vehicle engine system which overcomes the above-given disadvantages, that is which avoids heating the fuel and that is more energy-efficient than prior-art systems.

SUMMARY OF THE INVENTION

A motor-vehicle engine system has according to the invention an internal-combustion four-cycle engine having a fuel-supply manifold, a substantially closed but vented fuel tank holding a supply of gasoline, a fuel pump having an input connected to the tank and an output, and a fuel-feed line connected between the fuel-pump output and the fuel-supply manifold. A controller connected to the engine and to the pump operates the fuel pump at a throughput rate directly related to an engine speed. Insulation surrounds and thermally insulates the fuel tank, fuel-feed line, and fuel-supply manifold from their surroundings. A return line connected to the fuel tank is provided with an overpressure or pressure-relief valve that is controlled to open briefly only on startup of the engine.

The invention is based on the recognition that the fuel is heated by several sources. The tank and lines are juxtaposed with hot elements of the exhaust system and of the transmission and the fuel-supply manifold is on the hot engine block. In prior-art systems where there is a constant circulation of fuel through the return line, this heating effect is even worse. Thus by insulating these critical parts and largely suppressing the recirculation of the fuel, the heating effect is largely eliminated.

According to the invention the pump is at least 80% efficient, that is it converts at least 80% of the energy, typically electrical, powering it into mechanical energy moving the fuel. Thus it adds little heat to the system. This pump is thermally decoupled from the fuel tank, typically by mounting it physically separate from the fuel tank.

The controller operates the pump to maintain a constant static pressure in the fuel-feed line. The pump throughput can also be set at a fixed ratio to the revolutions-per-minute (rpm) of the engine.

To minimize heating the fuel the tank, fuel-feed line, and return line are made of plastic. The insulation is integrally bonded to the tank, fuel-feed line, and return line. The insulation can be sprayed onto the parts to form an integral bond therewith.

According to another feature of the invention only the fuel tank is insulated and the pump is mounted outside the tank. No return line or overpressure valve is used and the fuel pump is operated at a throughput rate directly related to engine fuel requirements. This system can also have if necessary a return line connected to the fuel tank, an overpressure valve connected between the return line and the fuel-supply manifold, and means connected to the overpressure valve for opening same briefly only on startup of the engine.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
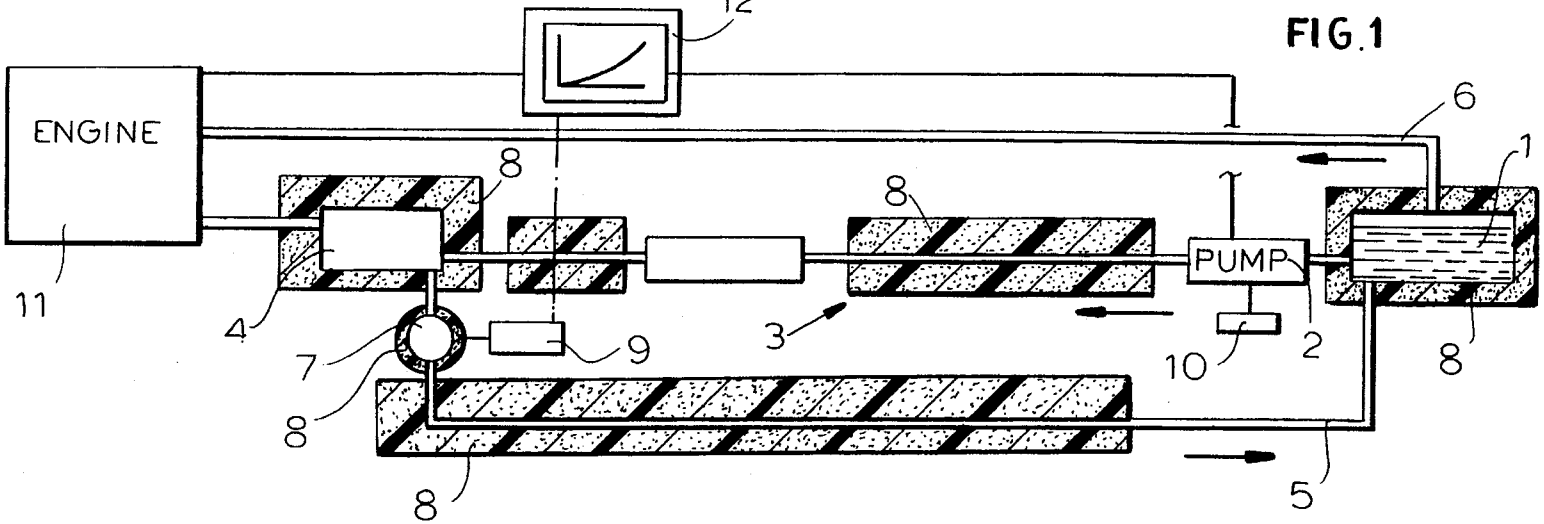
FIG. 1 is a largely schematic view of a fuel-injected motor-vehicle engine system according to the invention.

As seen in FIG. 1, fuel is extracted from a fuel tank 1 by a fuel pump 2 and passed through a fuel-feed system here formed by a single line or conduit 3 to a fuel-supply manifold 4 connected to a four-cycle internal-combustion engine 11. The tank 1 is sealed and vented, as usual, via a line 6 that goes to the intake manifold of the engine 11. Excess pressure in the supply manifold 4 is bled off via an overpressure valve 7 and fed back to the tank 1 through a return line 5.

A controller 12 of the engine 11 operates the pump 2 via an actuator 10 and the overpressure valve 7 via an actuator 9. The pump throughput rate is set by the controller 12 in accordance with the engine's need for fuel, that is in accordance with operating conditions. The valve 7 is normally only opened for a brief time when the engine is started and during normal operation is closed. The pump 2 may be operated to create a pressure pulse on startup to effect such opening of the valve 7.

All of the elements of the fuel system, including the tank 1, manifold 4, valve 7, and lines 3 and 5, are covered with insulating material 8. Here a polyurethane foam is used, although other thermal-insulating systems such as vacuum could be used. Polyurethane is particularly advantageous since the tank 1 and lines 3 and 5 are normally made at least partially of this material so the foam insulation adheres unitarily to these parts. The pump 2 is very efficient so that it operates cool. If it is mounted in the tank 1 it is insulated from the fuel. No insulation 8 is provided on the pump 2 when it is outside the tank 1 so that what little heat it does generate is dissipated.

Since with the system of this invention fuel is not normally circulated back though the return line 5, it is necessary to operate the pump 2 to maintain a constant static pressure in the fuel-supply manifold 4. If the valve 7 is to be opened, the pump 2 produces a pressure pulse that does this. Normally, however, the pump 2 is operated at a rate determined by engine speed so that the valve 7 stays closed.

Figure 2:
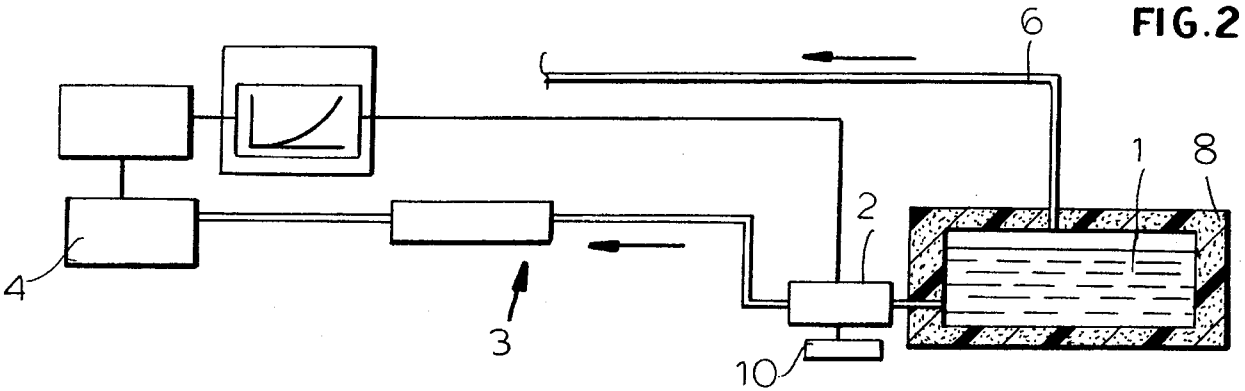
FIG. 2 is a view like FIG. 1 but showing an alternative arrangement.

FIG. 2 shows a similar system, but where there is no return line 5. In addition here only the fuel tank 1 is insulated and the pump 2 is outside this tank 1. The controller 12 here operates the pump 2 to exactly tailor the pump output to the engine speed, that is as rpm increases, the pump output is increased and vice versa. A return line 5 could be provided in this arrangement, in which case it would only operate at startup and would be insulated.

I claim:

1. A motor-vehicle engine system comprising:

an internal-combustion four-cycle engine having a fuel-supply manifold a substantially closed but vented fuel tank holding a supply of gasoline;

a fuel pump physically separate and thermally decoupled from the fuel tank and having an input connected to the tank and an output;

a fuel-feed line connected between the fuel-pump output and the fuel-supply manifold;

control means connected to the engine and to the pump for operating the fuel pump at a throughput rate directly related to an engine speed and for maintaining a constant static pressure in the fuel-feed line;

insulation surrounding and thermally insulating the fuel tank, fuel-feed line, and fuel-supply manifold from their surroundings;

a return line connected to the fuel tank;

an overpressure valve connected between the return line and the fuel-supply manifold; and means connected to the overpressure valve for opening same briefly only on startup of the engine.

2. The engine system defined in claim 1 wherein the pump is at least 80% efficient.

3. The engine system defined in claim 1 wherein the control means operates the pump in accordance with revolutions-per-minute of the engine.

4. The engine system defined in claim 1 wherein the tank, fuel-feed line, and return line are made of plastic.

5. The engine system defined in claim 4 wherein the insulation is integrally bonded to the tank, fuel-feed line, and return line.

6. A motor-vehicle engine system comprising:

an internal-combustion four-cycle engine having a fuel-supply manifold;

a substantially closed but vented fuel tank holding a supply of gasoline;

a fuel pump outside the tank and having an input connected to the tank and an output;

a fuel-feed line connected between the fuel-pump output and the fuel-supply manifold;

control means connected to the engine and to the pump for operating the fuel pump at a throughput rate directly related to engine fuel requirements;

insulation surrounding and thermally insulating the fuel tank from its surroundings;

a return line connected to the fuel tank;

an overpressure valve connected between the return line and the fuel-supply manifold; and means connected to the overpressure valve for opening same briefly only on startup of the engine.

* * * * *